United States Patent [19]

Andrews et al.

[11] 3,960,157

[45] June 1, 1976

[54] HAIR ROLLERS

[76] Inventors: Ann Andrews; Peter Andrews, both of 190 Gebhardt Road, Penfield, N.Y. 14526

[22] Filed: June 1, 1970

[21] Appl. No.: 42,506

Related U.S. Application Data

[63] Continuation-in-part of Ser. No. 432,576, Feb. 15, 1965.

[52] U.S. Cl. ..... 132/40

[51] Int. Cl.[2] ..... A45D 2/00

[58] Field of Search ..... 132/40, 41, 33, 42, 132/9, 44

[56] References Cited

UNITED STATES PATENTS

| | | | |
|---|---|---|---|
| 1,346,920 | 7/1920 | Steinacher | 132/44 |
| 3,109,437 | 11/1963 | Broyles | 132/9 |
| 3,144,027 | 8/1964 | Chalfin et al. | 132/40 |

*Primary Examiner*—G. E. McNeill

[57] ABSTRACT

An improved cushion padded, coaxially bendable and resilient and substantially diametrically rigid "hair roller" device for use, especially by persons, in the "hair roller or hair (do it yourself) art" whereby a person may sleep with and on the rollers dressed in their hair, and still substantially protect their scalp from, at least, becoming numb, dificient, generally unhealthy, and balding.

14 Claims, 11 Drawing Figures

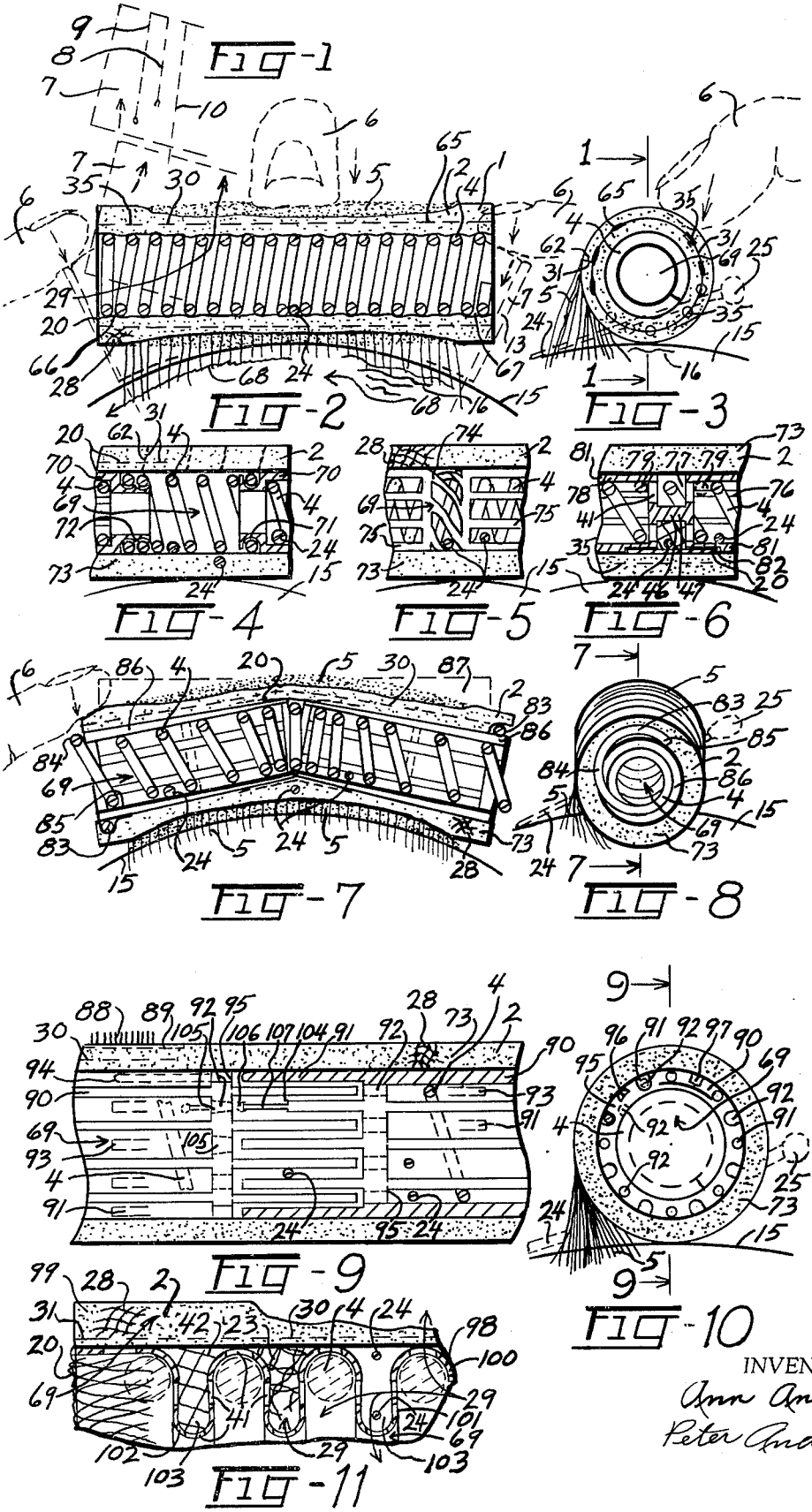
INVENTORS.
Ann Andrews
Peter Andrews

HAIR ROLLERS

This is a Continuation-In-Part application from copending Ser. No. 432,576 filed Feb. 15, 1965.

This invention relates to hair curlers and having particular reference to that type of hair curlers which are commonly known, in this time period, as "hair roller" because of their generally large diameter which readily permits having an air ventilated or an air permeable, generally hollow core or mandrel.

These hair rollers are generally used for making roller curls, which are dryingly formed around specially made hair rollers, as is known in the "hair roller" hair setting art, whereby a selected tress of hair is wound and secured therearound for giving, the female sex, a means by which their hair is caused to curl and/or giving a pleasing so-called permanent or even a temporary roll, wave or curl to their hair, as desired.

Many female persons, hereinafter may also be referred to as one or one's, roll or wind their own selected tresses of hair around various known so-called "hair rollers" and this do-it-yourself hair roller operation is known and is in widespread use today. For example, at night before one retires to bed for a next day dressing of their hair to thereby have a pleasing and attractive hair appearance, especially for the same or even the next day, or a desired length of time after the hair roller insertion operation into one's hair.

Most of the present day hair rollers, when dressed in one's hair are either; too pricky against one's scalp to sleep thereon and thereby would tend to cause or damage one's scalp and hair; too soft and spongy, diametrically wise, for giving one an even, tight and an efficient round hair curl, especially when sleeping thereon; too soft, core-wise diametrically, to thereby obtain a tight and efficient round curl when one is sleeping thereon; too rigid a core or mandrel, axially and diametrically, to thereby allow one to have a proper, rest or sleep and/or scalp and hair protection, expecially when one is resting their head thereon the roller, when sleeping.

For example, a roller core having a perforated or open tubular construction is disclosed in U.S. Pat. No. 3,016,909 and also having a generally soft core member for enhancing one's sleep. This core is thereby generally forced out of round, by one's sleeping and resting head, and also cannot bend axially without the core's middle section flattening out or buckling and thereby creating an undesired and uneven and out of round hair curl. It has also been found that when using the roller of U.S. Pat. No. 3,016,909 that pins or picks cannot be readily inserted with facility and ease at an extreme tangent angle through the roller core, and thereby correct positioning of the pin 46 and to one's scalp is not obtained. The core's construction and arrangement makes it generally impossible to insert a pin straight therethrough, at an extreme tangent angle. To make the perforations larger would result in a still undesired softer core which still could not generally bend axially, and further loose, uneven and out of round hair curls would result, when sleeping thereon. Furthermore, two correct perforations are not always selected without having the point of the inserted pin, at time, prickingly deflected downward into one's scalp. Thereby further unnecessary insertion and reinsertion, of the pin, through the padding around the core is executed, and especially when one is rolling their own hair and is tired. This thereby also creates a tedious task, especially when a desired hair roller tightness and adjacence to one's scalp is generally to be blindly obtained. Furthermore, because of the perforated core, pin perforating the core padding more than is necessary will result in a quicker padding deterioration or an inefficient delapidated core padding means, which creates uneven hair curls thereby.

U.S. Pat. No. 3,144,027, for example, its core could never be made to bend axially and still have a substantially round center core or mandrel. This hair roller device is further also at a greater disadvantage, than the 3,016,909, one, in that any pin insertion and reinsertion through the very few perforations, in its core, would create a still greater tedious task of especially setting one's own hair, and axial bending thereof, if possible, would create still further and greater disadvantages and undesired results towards one's scalp and hair protection, and sleeping comfort, and hair curl shape.

A very important object of this invention is to provide an improved tress of hair roller means which is particularly designed, constructed and arranged to thereby give a protection for one's scalp and thereby generally protect it from becoming hair roller, numbed; hair roller, pressured and thereby creating a lack of proper scalp blood circulation; hair roller, scalp cell impairing or damage thereof; hair roller, scalp balding condition; hair roller, undesirable sleeping discomfort or hair roller, scalp pressured, pain and the like; especially when one is resting their hair roller ladened head on the hair roller, especially when one is sleeping.

Another very important object of this invention is to provide an improved hair roller which is so constructed, arranged and designed, to thereby be characterized as being a "hair roller means" which will generally prevent; selected and rolled tress of hair, shaft, breakage; selected and rolled tress of hair, at least one general hair shaft, pullout from one's hair follicle or scalp; selected and rolled tress of hair, shaft, overstraining or overstretching damage thereto; selected tress of hair, shaft, brittleness and the like, that a times is caused by sleeping on an improper, prior art, hair roller.

A further important object of this invention is to provide an improved hair roller means which is so particularly constructed, arranged and designed to thereby give a, rolled thereon, selected tress of hair a desired, tight, efficient and substantially round curl, even when one is sleeping and thereby resting their head directly thereon this unique hair roller which has a core member which is generally rigid and substantially non-flattening diametrically-wise but still is generally bendable longitudinally or coaxially, as necessary or desired.

Another further important object of this invention, is to provide one with a hair roller means which also has a soft outer layer of material, which is substantially around an axially and universally flexible core member, and upon which material the selected tress of hair ends will find a clinging affinity effect thereto, as one rolls the tress of hair thereon. This hair end clinging effect thereby facilitates the otherwise generally blind and tedious operation of one, at least, rolling their own selected tress of hair thereon as well as giving the shaft of hair ends a desired rolled curl effect.

A still further important object of this invention, is to provide one with a hair roller means which is so constructed, arranged and designed that it will be particularly characterized as being a scalp cushioning hair roller having a generally rigid diametrically-wise but flexible axially-wise core member, whereby sleeping comfort is enhanced as well as having at the same time a scalp and hair protective hair roller means.

Another yet further important object of this invention is to provide one with a hair roller means, which is so constructed, arranged and designed, that one may go to sleep with virtually this "hair roller pillow" dressed in their hair. Thereby, stiff necks and the like which would easily be brought on by other, slept on, prior art diametrically and axially rigid rollers, is virtually eliminated.

Another object of this invention, is to provide one with a hair roller means which will also somewhat preserve one's otherwise lost scalp heat, which heat was previously preserved by one's hair prior to the tress of hair selection and hair roller insertion into one's hair. This hair roller will, if desired, generally hug, longitudinally and axially, closer to one's exposed scalp and thereby scalp heat loss is somewhat preserved. Head colds are also somewhat eliminated because drafts of air over one's damp hair and exposed scalp are thereby also somewhat eliminated when sleeping and especially when one is shopping or traveling with tresses of one's hair rolled around this improved hair roller and allowed to dry thereon.

Another object of this invention, is to provide one with a hair roller which is so constructed, arranged and designed that dandruff is generally prevented. Dandruff is increased and generally is caused by a sluggish condition of the scalp and occasioned by poor, scalp, blood circulation and lack of nerve stimulation, for example, as is also generally caused by one wearing a tight hat or cap for long periods of say 6, 8 or 10 hours, at one time. This improved roller having it's diametrically generally rigid core cushioned from one's scalp, will prevent this undesired scalp condition, especially by having the core member bendable coaxially to thereby prevent further unnecessary, scalp and roller pressure even when a kerchief is worn tightly over these improved hair rollers.

And another object of this invention, is to provide one with this improved hair roller whereby bobby pins, hair pins, hair roller clips and pins or picks may readily be employed, as desired. The pins or picks may, furthermore be inserted through this diametrical roller core portion, at substantially any angle or even at any extreme tangent angle, to thereby easily and conveniently obtain a desired hair roller to scalp adjacence or closeness effect, especially when one is rolling their own tresses of hair. Also hair roller maintenance cost is reduced by eliminating unnecessary pin perforating of the roller core's cushioning pad member, whereby the cushioning pad portion will give one a savings by having a longer and undelapidated, use thereof. An early replacement of the complete hair roller is thereby also generally prevented, especially if a replacement, for the roller's outer, delapidated, suctioning pad portion, is not available and further roller use is desired.

A further object of this invention, is to provide one with a hair roller means which also allows the selected tress of rolled hair to readily dry on this improved hair roller which is so constructed, arranged and designed that at least its core member is air permeable. but preferably, the complete roller means is preferred to be readily air permeable for substantially free passage of air therethrough as desired or deemed necessary.

A still further object of this invention, is to provide one with a hair roller means whereby at least the outer cushioning pad portion of the roller is in various desired colors, for thereby giving one a pleasing and attractive chic look, and especially whenever the hair rollers are dressed in one's hair whenever they are shopping; or out of one's own place of sleeping; or even when traveling; or even when going out for the evening, such as dining, dancing, entertainment, and the like.

Yet another object of this invention is to further reduce maintenance cost by providing one with this hair roller which may also be washed, cleaned, vacuumed, sterilized and the like. Maintenance cost is further reduced by providing one with a replacement out roller cushioning core pad, if desired, as well as providing a replacement of any single element or combination portion of the roller as may be desired or deemed necessary.

And yet another object of this invention is to provide a particular embodiment for this improved hair roller, in that it will be so constructed, arranged and designed to thereby provide a person with a means with which to compress and shorten the roller core length, if desired, so that generally any desired core, axial limpness, is thereby achieved, as well as also obtaining a shorter roller means, if desired. An axially limp and also an axially curved roller core means may also be achieved for giving one a curved hair curl, if desired, or generally a curved hair roller to match one's curved head and thereby also having, at the same time, substantially no cantilevered roller end, shaft of hair strain, even and especially when one is sleeping on only the hair roller ends.

These objects together with other objects and advantages, which will become apparent, reside in the details of construction, arrangement and operation, as more fully hereinafter described, shown, and claimed, with reference being made to the accompanying drawings forming a part hereof, wherein like numberals refer to like ports throughout, in which:

FIG. 1 is a dashed-line outline of a prior art axially rigid hair roller core, which has some shafts of hair thereon, and is rockingly forced into this upward angle, away from one's scalp, whenever a generally large force, as is shown in FIG. 1, is applied against the otherwise cantilevered roller end (not shown here) but see FIG. 2.

FIG. 2 shows a slightly modified axial cross-section of generally the first embodiment of the hair roller and which is taken along line 1—1 of FIG. 3.

FIG. 3 shows an end view of the roller shown in FIG. 13 and which roller is dressed in one's hair and generally located upon one's scalp.

FIGS. 4, 5 and 6 are all a generally flexing center portion, of still another modified axial cross-section of the hair roller, the result of which is generally shown by FIG. 7.

FIG. 7 shows an axial cross-section of this axial, center bending hair roller, having still further roller center bending construction and arrangement and is taken along line 7—7 of FIG. 8.

FIG. 8 shows an end view of the hair roller shown in FIG. 7 and which roller is bendingly dressed in one's hair, if desired, and is shown located upon one's scalp.

FIG. 9 is another construction and arrangement of another partial cross-section, of only the center portion of the modified hair roller embodiment, which, for example, are generally shown by FIGS. 4, 5, 6 and 7 and 18. FIG. 20 is taken along line 9—9 of FIG. 10.

FIG. 10 is an end view of the hair roller shown in FIG. 9 and which roller is shown dressed in one's hair and located upon one's scalp.

FIG. 11 is another embodiment of the hair roller bendable core member, which is only partially shown, but having substantially a bellows-like configuration, to thereby, as desired, obtain hair roller axial bendability which is in general accordance with at least one of the objects of this "hair roller" invention.

FIG. 1 is to clarify and thereby show an enlarged forced upward end, in dashed-line outline, of at least one prior art axially readily non-bendable hair roller 7 end and the hair damage, 8, 9 and 10, caused thereby to one's shafts of hair 5, especially when one is sleeping on hair roller 7 and which damage was previously described in FIG. 2 of Ser. No. 432,576 application and which damage is substantially prevented by this improved, for example hair roller 1, 45, 60 and the like disclosed herein this and the 432,576 specification.

FIG. 2 is a very slightly, coiled core 4 means, modified embodiment showing of hair roller 1, as in FIG. 2. of the 432,576 application. The universally resilient, flexible and bendable, core 4 means shown in FIG. 2 will generally prevent the cushioning pad material 2 which is preferred to be a substantially resilient, flexible and soft air permeable, open cell, foam material or 28 material which is a soft, scalp non-pricking, cushioning material, from being forced in between the coils by one's rolled thereon hair 5 because the coil pitch distance is substantially short. Also a substantially limper, axially, hair roller 1 is thereby obtained, especially if it is desired to not use a cushioning pad reinforcing means 20 and 30, or even the flat, rectangular or substantially round pin-like member 35 and the like all three of which are fully described in my issued patent number 3,653,391 and which, if used, has been found to somewhat generally stiffen the axial flexure or bending of the hair roller 1 and is substantially axially stiffer when a bonded or an integral mesh 22, as shown in FIG. 11 for example, is used. A layered, joined together, pad 2 or 28 material may be used, if desired, whereby sewing, adhesive, stapling and the like 65 layer joining means may be used for stiffening or reinforcing the pad 2 or 28 across the core 4 coils. A sewed, axially, obliquely or criss-crossed, means 65 or an adhesive strip-like means 65 which is applied, axially, obliquely or in a mesh-like criss-cross pattern may also be used, if desired. Adhesive means 65, which if used inbetween the layers of pad 2 or 28, or 2 and 28, may also be applied, thereinbetween, in a dashed-line or a poka-dot pattern, for thereby adhesively joining together the, disclosed, layered cushioning pad material. A substantially whole layer of adhesive 31 means, shown in FIG. 3, will somewhat hamper air permeability or air circulation through the adhesive seam or layer 31 of joined pad 2 or 28, or pad 2 and 28, but in effect may be desired if found necessary to use adhesive 31 means for thereby universally reinforcing the cushioning pad material axially and diametrically on the open coiled core 4. The pitch distance from coil to coil of core 4 is preferred to be substantially the diameter of the shaft 24 of pin 25 shown in FIG. 3, but a closed coil spacing 67 throughout the longitudinal length or a slightly open or no initial load coil spacing 67 may also be used, if desired throughout. The reinforcing means 35, 30 and the like may also be used, if desired as deemed necessary. The scalp-undesired roller pressure numbing area 16 is shown off-center on scalp 15, which pressure is greatly increased as one sleeps thereon, the dashed line, finger 6 forced down roller 7 end of a prior art roller 7. Thereby the other end of a roller 7 is forced into the air, away from one's scalp, whereby strand of hair 5 damage also occurs as is fully shown and was described in FIG. 1. The circulation of one's scalp blood is shown diverted, around the numbing 16 wavy lines, and is shown by the sharply curved line and arrow means 68. The cushioned hair roller 1 is shown substantially on the scalps 15 center but blood curculation is shown as being substantially uninterrupted by the gradual smooth curved line and arrow means 68 and scalp numbing lines 16 are not shown because the cushioned 2, roller 1 core 4 will bend axially and a concentrated scalp numbing 16 area is thereby substantially prevented. Furthermore the greatest bulk, of the selected and rolled therearound tress of hair 5, is substantially in the center of this, for example, roller 1 or a prior art roller 7, whereby the axially bending roller 1 has a distinct further advantage in that it will bend axially on and around the, also scalp cushioning bulk of rolled hair 5. The roller 7, prior art, by not being axially bendable tends to rockingly shift itself off of the greatest bulk of rolled hair and thereby substantially loses, partly at least, its previous hair bulk, scalp cushioning means, and thereby further readily numbs 16 one's scalp 15, because of its hair cushioning loss, as is generally shown on the right side of FIG. 2. Also one's proper blood circulation is thereby generally interrupted and is indicated by the generally sharp curved line and arrow 68 designation. One may sleep for 4, 6, or even more hours at a single time thereon hair rollers and thereby one's scalp 15, if allowed to be repeatedly numbed 16 for that length of time, would gradually be damaged and their hair 5 also damaged, in appearance, growth, health, and the like previously disclosed herebefore. The remainder of FIG. 2 is thought to be self-explanatory from the previous disclosure in FIG. 12 and need not be repeated herenow.

FIG. 3 shows a person's finger 6 being forced against the diametrical outer peripherial portion of the roller 1 which is thereby forced against one's scalp 15 as is also shown in FIG. 2. This action thereby also shows that even though the roller 1 core 4 is readily limp axially yet it is substantially rigid diametrically. That is, the roller cores 4 cross section is not substantially altered even when at the same time also axially bends the roller core 4 into an arched form. This diametrical rigidity thereby substantially preserves one'S rolled tress of hair 5 in a desired substantially round curl form, even when one is sleeping thereon the preferred, air permeable, coiled core 4 outer cushion padded, hair roller 1. The adhesive strip-like means 65 is shown in spaced relation end view, which may be that of an axially parallel or poka-dot or dashed-line like or square mesh like or oblique to the rollers axis or obliquely criss-crossed mesh-like, applied adhesive strip-like means 65. A two sided adhesive coated tape-like strip of material may also be used, if desired, in place of the directly applied to adhesive means upon at least one of the inbetween surfaces, of the layered pad 2 or 28, or pad 2 and 28. A perforated two sided adhesive coated, tape or perforated sheet of material, may also be used for joining the layers of cushioning pad material, if desired, whereby air permeability, through the disclosed perforated tape or sheet which adhesively joins the cushioning pad layers of material together, is thereby enhanced. The pad 2 or 28, or pad 2 and 28 conbination may both be in any desired shape or a preferred tubular longitudinally seamed or integral one piece tubular form, as desired, and which one piece tubular form is generally shown throughout the drawings. Also a sheet, or strip or strips of pad 2 or 28 material may also be adhesively secured over and around an elongated tubular shaped open mesh material 30 which is around a tubular shaped, cushioning pad 2 or 28 material, if desired. The seam 62 which is also disclosed in FIG. 9 and also in FIG. 10 of the 432,576 application and having an adhesive means 31 therein is also shown in FIG. 3. Strips of pad 2 or 28 material may also be adhesively secured, at least by its sides, over the construction and arrangement as shown in FIG'S. 4, 5, 6, 7, 9 and 10, if desired and deemed necessary.

FIG'S. 4, 5, 6, 7 and 9, generally shows a construction and arrangement of still another modified embodiment of a partly axially or coaxially flexible or bendable, in substantially its center portion only, hair roller 73, as is generally shown in FIG. 7. FIG. 4 having a coiled core 4 means which is substantially resilient, flexible, and axially or coaxially bendable, but yet is generally diametrically rigid. Both core 4 end coils are coiled into a circular groove 71 which is therein, shown in end for illustration only, both left and right air permeable tubular cage-like or tubular perforated members 70. The tubular members may be diametrically generally soft, semi-rigid, or rigid, as desired, and a separate coiled core 4 diametrical reinforcing means may also be in each cage-like core 70, if desired, and which is only partly shown in the left and right shown cage-like core 70 as an illustration thereof only.

The cage-like cores 70 inner ends may also both have a helical grooved member 72 for coilingly securing each end of the large center core 4 means to each inner end of the cage-like cores 70, which helical inner end is shown only on one cage-like core 70 for simplicity of illustration only, as is groove 71. The mesh 20 reinforcing means may also be substantially over the center coiled core 4 means, as desired, or over the whole diametrical length of roller 73 and/or even having its ends tucked into the center axial opening 69, as is generally shown, for example, in FIG. 11. The adhesive 31 or reinforcing mesh means 20, 30, 35, and the like is to be also understood as being in pad 2 or 28, or thereon and against the cage-like cores 70 and being, of course, across the center core 4 means, as and if desired. A strip of pad 2 or 28 material may also be helically wound around any of the roller cores or cage-like cores shown in the FIG'S. 4, 5, 6, 7 and 9, if desired. The seam 62, having adhesive means 31 therein, is shown in dashed lines. Scalp 15 and the shaft 24, of pin 25 (not shown), may be inserted through the center coiled core 4, or through the cage-like core 70, or through pad 2 or 28, if desired. A bobby pin 26 or hair clip 26 (not shown) may also be inserted into the axial center roller opening 69, if desired, and also in any of the rollers 73 axial center openings 69 shown in FIG.—S. 5, 6, 7, 9 and 11, if desired, as is known and is used in the hair, roller setting art.

Reference should be made to FIG. 1 of copending application Ser. No. 432,576 and apply the construction to FIG. 2 and being the diametrically circular cross-sections 4 of a coiled wire-like core, spring-like means, in an open and free length, as shown by the "X" length indicator and the spring-like core also may have preferred closed ends 3, as is shown in FIG. 1 of copending application Serial No. 432,576 and also a compressed spring-like coiled core means as is indicated by the "Y" length indication. By coaxially compressing the coiled spring-like core means, one to the position shown in FIG. 2 will thereby have a shorter hair roller length, if desired, or a hair roller having a softer or generally limp hair roller means, which will readily bend axially towards one's scalp whenever a person's finger or kerschief, pillow means or even when a shrinking and drying hair shaft length shown in dashed line 13, as shown in FIG. 2, that tends to pull and the other disclosed prior force means tends to push the generally cantilevered hair roller 1 towards one's scalp, as is also generally shown, for example, in FIG. 2. The advantages which one will thereby obtain from this generally resilient and flexible, coaxially or axially, improved hair roller, will be fully disclosed in the disclosure which will hereafter follow.

FIG. 2 shows a preferred embodiment of the hair roller 1, the preferred readily air permeable roller core cushioning pad material 2 and/or 28; a coiled wire-like core means 4, selected tress of hair shafts 5, a person's finger 6 which is shown forcing the generally cantilevered hair roller ends, as is shown in dashed line outline, downward towards one's scalp 15, to thereby illustrate just how this cushioned and axially, resilient, flexible, bendable, soft, limp, and the like, as desired, hair roller 1 will thereby generally protect one's scalp 15 and hair 5 or specifically from the 8 broken and 9 pull out condition from the follicle (not shown) as shown in FIG. 1. This uniquely constructed, arranged and designed hair roller 1 will also generally at least curtail, hair roller, balding of one's scalp 15, breakage of one's hair shafts 8, damage to one's hair shafts through excessive stretching 10 thereof shown in dashed line in FIG. 1, especially when an end of the hair roller is rockingly forced upwards and away from one's scalp 15, as shown by the dashed line outline, and being generally at least one prior art axially rigid hair roller means 7, and especially when one does have them dressed in their hair and is sleeping on the rollers 7. Shaft of hair pullout 9 from one's scalp 15 or follicle (not shown) is also generally prevented when one uses this improved hair roller and being substantially characterized as being a cushion pad 2 or 28 covered hair roller means 1. The roller 1 is also characterized as being a cushioned, diametrically rigid roller but one which will also at the same time bend substantially longitudinally and/or axially, as is shown by the dashed line position of the roller 1 end, in FIG. 2. The scalp concentrated and pressured or numbed area 16, is thereby also substantially eliminated, whereby a greater roller distribution upon a greater area of one's scalp is obtained, especially when one is sleeping on the hair roller 1. A hair roller created sluggish scalp condition is generally thereby prevented, and a proper blood circulation and nerve stimulation of one's scalp is also thereby allowed to continue, and dandruff will thereby not be increased; hair roller impairing of the health and growth of one's scalp cells will generally be prevented; proper hair growth will not be hair roller hampered; and hair roller balding scalp condition will thereby be substantially prevented. All this and more objects are and is accomplished by one merely using this substantially diametrically rigid, core cushioned but axially bendable improved hair roller 1.

It is also know that normal dry hair can be stretched to about one-fifth of its natural length and when the hair 5 is wet, it can generally be stretched to about 40 or 50 percent of its length. With the foregoing in mind, FIG. 2 shows a shaft of hair 13 in dashed line outline, that is generally wetted and rolled around an end of roller 1, whereby the stretched shaft of hair 13 will tend to shrink in length and thereby generally pull the cantilevered roller end downward towards one's scalp 15 as shown in dashed line outline in FIG. 2. The shaft of hair will thereby not be strained 10, as is shown in dashed line outline in FIG. 1 by use of an axially rigid prior art roller 7, for example, or strainingly breaking itself into two separate parts 8, or even pulling itself out 9 of the scalps follicle (not shown) or even pull itself from the hair papilla (not shown).

It is preferred to have a hair roller 1 having a netting or mesh means 20, shown in FIG. 2 of copending Serial No. 432,576 or FIG. 11, that is preferred to be formed over and into the roller's open end, as is now generally being done with some of the prior art, mesh covered, wire coiled core hair rollers, which do or do not have a brush means therein, for example, prior art brush type of hair roller means. The mesh means 20 is generally a simple crisscrossed, oblique angled mesh or netting, but a chignon foundation roller of elasticized mesh 42, shown in FIG. 11, that has an elastic member or woven therethrough the oblique angled mesh, or a multiple oblique-angled crisscross mesh 23 or even an integral mesh, which is integral at least of some of the mesh crossing points 22, as shown in FIG. 2 of Serial No. 432,576 application, that may also be used as desired. These disclosed examples of a meshed material should thereby hereafter be understood as being substantially a mesh material means 20, to thereby establish a clear meaning, for example, of what a mesh material 20 will hereafter in this specification and claims will thereby generally and substantially represent. Also by use of such mesh means 20, the roller coiled core 4 will be permitted to bend coaxially or axially, as necessary, for one to thereby obtain at least one main object, of this invention, accordingly.

FIG. 2 further shows a person's finger 6 being forced against the diametrical outer portion of roller 1, as is also generally shown in FIG. 3, to thereby illustrate that the coiled core 4 is substantially rigid and will thereby retain its substantially round diametrical cross section, even when one has their hair set by employing this uniquely cushioned and axially bendable hair roller and is sleeping thereon. The rolled tresses of hair 5 will also thereby dry into an efficient and substantially round curl, even when one is sleeping. Furthermore one's scalp and hair is protected to an utmost degree by having the diamettrically, substantially rigid core 4 cushioned from one's scalp especially when one is sleeping, by having the preferred readily air permeable cushioning pad material 2 or 28, which also enhances one's sleep thereby and which cushioning pad material will readily allow the shaft of hair 5 ends (not shown) to be conveniently rolled on its generally soft or a soft and resilient, in at least one portion of its outer surface.

FIG. 3 further shows that pin 25 may readily be inserted through the pad material 2 and at substantially any tangent angle through the coiled roller core 4 to thereby secure the roller 1 on one's scalp for example, as shown. The shaft portion 24 of pin or pick 25 is, for example, shown in FIG. 2, between two coils of the core 4 as well as in FIG. 5, wherein the end of shaft 24 of pin 25, is resting adjacently against the scalp 15, as is desired and is known in the art of hair, large diameter roller, setting. A bobby pin or hair clip 26 may also be used, for example, in place of pin 25, if desired, as is known in the large hair roller setting art, shown in FIGS. 3, 5, 7, and 9 of copending application Serial No. 432,576, for example.

The pad 2 or 28 may be a layer construction whereby the upper layer being the cushioning pad material 2 or 28 as desired, and each layer may be of the same air permeable characteristic or different as desired, for example. The lower layer may also be readily air permeable, especially if it is constructed of a not too closely a spaced fiber bonded resilient material 28, as desired. The upper layer of roller scalp cushioning pad material 2 or 28 means is preferred to be a substantially soft, readily air permeable, material, and have perforated openings through its wall thickness, if desired. For example, open cell foam, a polyurethane, polyester, polyether and the like open cell foam, a rubber latex foam, a plastic foam and the like, and also a so-called "Scott-Foam" may, be employed or used as desired. A mesh reinforcing means 30 is preferred to be substantially therein or on the inside wall of the pad material 2 or 28 and be either loose, sewed, or adhesively secured thereto as desired, to thereby prevent the material from being forced inbetween the core 4 coils and forming the protrusion 38 as is shown in FIG. 4, for example, of Serial No. 432,576 application. The mesh 30 cushioning pad material reinforcing means, being substantially the previous mesh 20, may also be inserted inbetween the layers of pad material 2 and/or 28 and adhesively 31 secured inbetween, sewed, or secured, as desired. The mesh material 30 may also be a generally non-cementable plastic material, for example, polyestor, polypropylene, ployethelene, and the like, whereby the adhesive means 31 would only then join and substantially spot adhesively secure together the layers of material 2 and/or 28 through at least some of the mesh openings, for example, shown in FIG. 4 of Ser. No. 432,576 application and be coaxially and universally and substantially loose, that is, not directly adhesively secured to material 2 and/or 28, and also in effect, the cushioning pad material 2 and/or 28 will itself retain the mesh 30 in a loose but captive position thereinbetween as desired. The material 28 also may, first, be placed around the core 4 and, second, the mesh 30 is placed around and upon the material 28, and, third, the outer layer of material 2 be embraced over the mesh 30, whereby only frictional means would then retain the mesh 30 thereinbetween. This latter operation will, for example, generally force the material 28 against the open coiled core 4 and thereby automatically create the inwardly formed protrusions. The mesh 30 would also thereby substantially have, for example, some protrusions, (not shown) up in the mesh 30 openings (not shown), and the outer layer of material 2 would generally contact the raised latter spot-like protrusions for frictional contact therewith, if desired. The latter protrusion effect would be governed by the size of the mesh 30 openings, the softness and resilience of material 28, and the amount of mesh force upon the material 28.

An alternate flat, rectangular or substantially round, pin-like 35, cushioning pad 2 and 28, reinforcing means is inbetween the layered cushioning pad or if the pad 2 is a single layered material, the pins 35 could then be secured to the inside wall of pad 2 by sewing, adhesive means and the like, if desired. The mesh 30 means would also thereby not be used if desired, especially if the pins 35 are spaced in close relationship, substantially as shown. The end of pin 35 may be terminated 36 in the pad 2 or terminate at the edge 37 of pad 2, as desired. Also the pins 35 are shown in paraller spaced axial relationship, but they may also be in spaced relationship and in an oblique angle to the longitudinal axis of the roller core, 4, if desired. If the pin means 35 were substantially in two layers and each layer obliquely spaced, directly or indirectly, over each other, in opposite directions, then this criss-cross arrangement and contruction would generally be a mesh construction and thereby considered as a mesh material 30, even if they were not in actual direct contact at their crossover points. Pin 35 could also be made integral with the inner or outer diametrical ends of core 4.

Cushioning pad material 2, which may also be a layered material, as in FIG. 4 of copending application Ser. No. 432,576 and having a reinforcing means, 20, 30, or 35 thereinbetween the layers and/or pad 2 may be a single layer and thereby have the pad 2 reinforcing means 20, 30 or 35 directly against the core member 45 outer circumferential diametrical portion, if desired, and generally as shown.

It should be noted that the coiled wire tubular-like member 4 may also be replaced with a plastic coiled member means as is the pad material 2 shown in FIG. 4, for example, and the separation between the coils would be in at least one portion thereof like the diagonal lines or seams 62 and having air holes 18 which are shown in FIG. 2 of 432,576 application through the coiled plastic disclosed body accordingly.

FIG. 5 shows a roller 73 having an integral one-piece cage-like or perforated core 75 which is air permeable and has a flexuous, zigzag, herringbone, or helically integral, strip-like 75, center section whereby axial flexing or bending of the assembled roller core 73 is made substantially possible, for example, as is the roller 73 center bending axial feature that is shown in FIG. 7. The inner coiled core 4, at least diametrical reinforcing means is inserted inside to substantially the length of core 75, if desired, or the core 4 ends are extended and anchored over the ends of core 75, as is generally shown in FIG. 7, being over the ends of the two air-permeable cage-like or perforated cores 86. This latter resilient core 4 end anchoring means will resiliently aid the cores 75 center 74 universally flexible portion to substantially return to its initial pre-hair 5 rolled on, roller position. By the roller 73 having cushioning pad 2 or 28 directly around the outer peripherial longitudinal portion of core 75, which has the disclosed flexible center 74 and also having the resilient coiled core 4 means inside, core 75, the roller 73 thereby if bent axially, as shown for example in FIG. 7 will at least return to its axially, substantially straight, rod-like state. The strip-like center 74 also reinforces and substantially prevents a portion of pad 2 or 28 from being forced inbetween the coils of core 4 by the rolled therearound hair 5. The core 4 end anchoring means when used, will also hold the core 75 in a substantially captive position and also generally help retain pad 2 or 28 on core 75, especially if adhesive means or protruding pointed integral projections are not used on the outer peripherial portion of core 75, as is known in the art for retaining a roller cushioning pad on, for example, a perforated plastic core or mandrel.

FIG. 6 shows another slightly modified core 78 of a hiar roller 73 embodiment. The core 78 has a generally dumb-bell like shape and having an integral center, universally axially, bendable core 46 which integrally spaces 77 apart two air permeable cage-like or perforated, one open ended, cores 81, that is, two open ended cores 81 having a diametrically opposed inside wall, which is integrally connected, to a horizontal, coaxially positioned, integral member 46. A reinforcing means, mesh 20 material is shown as generally spanning across and beyond on each side of the spacing 77 between the cores 81, whereby the pad 2 or 28 material will not be forced into the disclosed space by hair 5 (not shown) whenever it is roller therearound the roller 73 and upon pad 2 or 28, for example, as is generally shown in FIG. 7. The shouldered recess-like space 82, which is partly in each roller core 81 and is substantially axially longer that the mesh 20 and, will thereby captively retain the mesh 20 therein or any other reinforcing means disclosed in this specification; if desired and especially when having the pad 2 or 28 thereon and around its outer generally peripherial diametrical portion. Of course the recess 82 may be eliminated and thereby the mesh 20, for example, if desired will be therearound a longitudinal portion of each core 81, that is adjacent to the space 77 and having its inside bottom wall integrally connected to a core 46, 47 and the like. The outer peripherial diametrical surface of each core 81 may also have small protrusions (not shown) which engage at least some of the mesh 20 and the like openings therein, for aiding in the retaining of mesh 20's generally captive position thereon. Also the two ends of mesh 20 and the like are preferred to be made unraveling proof as is desired and known in the art. A coiled resilient core member 47 of Ser. No. 432,576 parent application, may also be used generally in space 77, to thereby make connections to the core 81 inside diametrically opposed wall, in place of integral core 46, if desired. The coiled core 4 means may be also used, one in each central axial opening, of the cores 81 or only one long coiled core 4 which is inserted into one end core 81 axial opening, threaded through opening 41, which may be in each diametrically opposed inside and wall of cores 81 and then core 4 is rotatingly threaded through the axial opening in the other core 81. The coiled core 4, inserted length, is substantially the length of the complete dumbell shaped core 78, or each end of coiled core 4 is captively engaged over the two outer ends of the core 78, as is generally shown over the ends of the two cores 86 in FIG. 7, if desired. The shaft 24 of pin 25 (latter not shown) is shown inserted through, for example, the right sided end core 81 portion but also may be inserted through the mesh 20 and space 77, as well as through (not shown) pad 2 or 28, if desired, but is shown, for example, through pad 2 and 28, in FIG. 7. The mesh 20 or reinforcing means 35 may also be in the pad 2 or 28, if desired. The entire length of the reinforcing means 35, generally round pin-like structure, may also be inserted ram-like directly into the edge end into the diametrically opposed length of pad 2 or 28, as, for example, is the entire length of a pin which is inserted into the edge of a thick, soft, material, or as is an entire length of a steel nail which is driven into the edge of a board and its length being substantially parallel to the face of the board yet does not protrude out the other edge thereof, and thereby a layered pad 2 or 28 will not be necessary. Also a reinforcing pin-like means 38, for example, may be stitchingly inserted in and out, coaxially, of the intended or inner tubular surfact wall portion of pad 2 or 28, if desired, for example, as is a blind stitched material or cloth having a dashed line-like exposed needle therein and which needle length is substantially parallel to the outer unexposed, needle, material surface. That is, for example, insert and leave the needle in the material and thereby having, in effect, a blind needle stitching means of support and securing means for the pad 2 or 28 material which is thereabove the entire length of the generally hidden needle therebelow. The reinforcing means 35 will thereby be against the core 4, for example in FIG. 7 and the like and generally blind stitch held by the pad 2 or 28 material. The reinforcing means 35, for example, is thereby not visible when a person is looking directly at the outer diametrical longitudinal surface, for example, of the disclosed hair roller FIG. 7 hereabove.

The cushioning pad material 2 is preferred to be a substantially resilient, flexible, and soft readily air permeable, open cell foam material but it may also be a fiber bonded 28 material which is thereby substantially resilient, flexible air permeable, and soft. A soft, scalp non-pricking, cushioning pad material 28, is preferred. Perforations 18, which are shown in dashed-line outline and are shown through the material 2 or 28 may also be used, if desired, for example, to thereby aid in reducing the drying time of one's generally damp hair 5 around the roller 1. Partial closed ended pockets, 17 and 19, or either 17 or 19 may also be in the material 2 or 28, if desired, for thereby shortening or improving the drying of one's rolled tress of hair 5 and/or for improving the cushioning pad, roller core 4, characteristic of the material 2 or 28 towards one's scalp. The mesh 20 in FIG. 4 acts as a reinforcement as it spans across the outer peripherial coils of core 4 and thereby prevents the cushioning pad 2 or 28 from being partially forced inbetween the coils of the roller core 4. In FIG. 2, the damaging or generally the scalp numbing area 16 is also shown, whereby a person can readily understand why this cushioned and axially bendable core hair roller is an improvement, over prior art which are either, air non-permeable and/or axially non-bendable hair rollers and/or diametrically rigid, all at the same time.

FIG. 7 shows another modified version of hair roller 73 embodiment wherein two substantially separate, air permeable, perforated or cage-like cores 86 are, diametrically opposed butt ended together and are also held butt ended together by a resilient, flexible coiled core 4 means which has one of its two coiled core 4 ends anchoringly uncoiled over one unbutted end of one of the cores 86 and the other coiled core 4 and is also similarly or likewise, if desired, anchoringly coiled from the inside of core 86, and is coiled over and back onto the other core 86 and as is generally shown herein and in FIG. 8. The ends of core 4 are preferred that they be terminated into an opening in core 86 or at least on an outer diametrical surface of core 86 as is generally shown in FIG. 8 of core 4, and 85. In the lower left corner, of FIG. 7, it shows end 85, for example, as being substantially terminated therein and opening of core 86, and also at the opposite and unbutted end of the other core 86, if desired. This, FIG. 7, hair roller 73 has a pad 2 or 28 material over which generally bends axially but only at the center portion which is reinforced, for example, by the preferred location for mesh 20 and the like previous disclosed, as desired, and thereby the cushioning pad material 2 or 28 is substantially prevented from being forced by the rolled on tress of hair 5, inbetween opened up triangular shaped opening between the cores 86, especially when one is sleeping on the now oblique angled, opened up, roller 73. The mesh 20 and the like, may also be eliminated, whereby the core 4 coils which are in the angular space between the cores 86, as shown, will generally at least somewhat support the pad 2 or 28 material from being forced deeply therein and especially if a reinforcing means 30, 31, 35, sewing means, and the like, is in the pad 2 or 28 material as previously disclosed and used as desired or deemed necessary. Also pinching together of the pad 2 or 28 material, which would otherwise be in the opening is substantially prevented by having a reinforcing means 20 and the like, directly over the angular shaped opening, whenever the roller cores 86 are returned to their initial butted together position. Also the uppermost portions of the raised inner diametrical portions of cores 86 will find less friction against the inside diametrical surface of, for example, mesh 20 and the like. Shaft 24 cross section is also shown as being tangently through the diametrical portion of one core 86 and through the pad 2 or 28 material, if desired, axial opening 69 is also shown by arrow means, whereby bobby pins or hair clips and the like 26, (not shown) may also be used, if desired, as previously disclosed in other FIG'S. in this specification. The reinforcing coiled core 4 means substantially prevents the outer longitudinal diametrical portion of cores 86 from being diametrically squeezed or forced into a generally out of round, oval and the like, especially when one is sleeping indirectly on the cores 86, whereby if squeezed oval, for example, the rolled on tress of hair 5 would thereby be formed and dried into a substantially out of round hair 5 curl, which is not generally desired in the present time period hair roller setting art, for example, rigid magnetic hair rollers are generally desired by beauticians because they form a substantially round, dired thereon, hair 5 curl. FIG. 7 further shows an, opened up, substantially oblique angled hair roller 73, which thereby is in a desired sleepp enhancing, oblique angled position, and also in a scalp 15 and hair 5, protective position, because of the substantially large distribution of, scalp 15 and hair 5, hair roller cores 86 cushioning pad 2 or 28 generally contacting coverage, as shown. Thereby, a person will readily, for example, observe that such a disclosed result is apparent and enhancing to one's sleep and scalp 15 and hair 5 protection, expecially if the diametrically central opened up portion between the cores 86 are generally held in the shown position by a force which is exerted thereaginst and generally diametrically and indirectly thereon, for example, mesh 20 and the like or directly diametrically on pad 2 or 28, by hair 5, as it is diametrically shrinking and/or is indirectly pressing inbetween, for example, the opened up diametrically opposed ends of cores 86. A pillow, the back of a chair, kerchief and the like, would also thereby be generally forced against the outer diametrical portion of roller 73, as shown, for example, by finger 6. Two separate bobby pines or hair clips (not shown) may one in each end of the roller's 73 out open 69 end of, for example, core 86, or even into each outer end of core 4 or the cores of FIG'S. 2, 6, 10 of copending application Ser. No. 432,576 and, 2, 4, 5, 6, 9, 11 and the like of this application, whereby, if desired, the hair rollers would generally have a closer adjacence to one's scalp 15, substantially throughout its longitudinal length and, for example, the roller cantilevering end 11 effect is thereby substantially reduced or generally eliminated. The shaft 24 of two separate pins 25 (latter not shown) may also be inserted through the roller's diametrical portion for retaining the hair roller, for example, 73 as is generally shown in this FIG.

7, through each core 86, or in two places through pad 2 or 28, also if desired.

FIG. 8 end view shows, opening 69, pad 2 or 28 means hair 5 which is also rolled around roller 73, round-like scalp 15, uncoiled coil portion 83 of coiled core 4, and curved terminating end 85 of coil 4 which is at least against the end of core 86, but is preferred to be at least on the outer diametrical longitudinal portion of core 86, as shown.

FIG. 9 is a further or another slightly modified embodiment version of the cage-like or perforated cores 90, of roller 73. The pad 2 or 28 is over the two cores 90 which are axially hollow, generally as are the cores 86 of FIG. 7. The cores 90 have finger-like or substantially diametrically opposed comb-like like projections 91 which thereby are substantially interrelated adjacently and generally parallel to the fingers 91 of a same roller core 90. The cores 90 are thereby two of the same generally single core 90, whereby only one type of core 90 is necessary for making up the entire length of the cage-like or perforated, universally center bendable, core of roller 73, having the spiral coiled core 4 therein, substantially the length of the above combined two cores 90, as is generally shown in FIG. 9. The spiral coiled core 4 means may also be anchored over the ends of cores 90, as is substantially shown over ends of cores 86, of FIG'S. 7 and 8, if desired. The fingers 91 may be generally round, in cross section, rectangular, or half round, as desired. Also the fingers 91 may have generally rounded 94 or square 93 ends, if desired. The fingers 91 free ends may also be in end spaced relation to the opposite core 90, finger 91 integral ring portion, as shown, or the fingers 91 may be loosely nested in the grooves 92, of each core ring 95, and thereby the two cores would be generally coaxially within each other, for example, as is shown by the finger 91 dashed lines. The diametrically opposed finger 91 diametrically opposed grooves 92 may be in the outer or inner diametrical portion of ring 95, if desired, or the fingers 91 may be loosely in diametrically opposed holes 92 which are in the wall of ring 95, if desired. The pad 2 or 28 would thereby not require a reinforcing means 20, 30, 35 and the like, which are generally necessary over the opened up space, which is between the roller core 86 ends, for example, as is shown in FIG. 7. The fingers 91 thereby substantially eliminates the need for a reinforcing means thereabove to generally prevent pad 2 or 28 from being forced inbetween (not shown) the rings 95. A reinforced means 30, 35 and the like may be in, for example, the layered or plain pad 2 or 28 material, if desired. The pad 2 or 28 may also have a short upstanding nap or pile 88, as are generally used on paint rollers and the like. The nap 88 is preferred to be secured to a base layer of air permeable or perforated material 89 which is preferred to be adhesively, sewed, and the like, secured to the, roller 73, pad 2 or 28 outer diametrical and longitudinal surface, if desired, whereby some of one's strands or shafts of the selected tress of hair 5 will readily lodge themselves inbetween the upstanding nap 88 and thereby enhance the initial hair 5 rolling operation, especially when one is rolling her own hair. This latter nap 88 hair 5 rolling enhancing operations generally protects one's hair and scalp because it is soft and non-pricking towards one's scalp, especially when one is sleeping thereon. The latter nap 88 is substantially a soft brush, hair 5, roller means. The nap 88, pad 2 or 28, combination has been found to be very enhancing with substantial satisfaction towards, scalp 15, and hair 5, and hair 5 ends protection, especially protection against hair shaft split ends. The shaft 24 cross-section is shown inserted inbetween the fingers 91 or through the core 90, if so desired.

FIG. 10 shows the cross section of a pin 91 being in a halfround 96, round 91, square or rectangular and the like. Coaxial running groove 92 generally has a coaxially running radius in its bottom portion or a square or rectangular 97 shaped, if desired, in the core 90 ring like inner end portion 95, for example, in the outer diametrical or inner diametrical portion of the core and generally as shown. Also an opening 93 in the ring-like inner end 95, core 90 portion, may also be coaxially therethrough, for captively receiving the fingers 91 therein, if desired, instead of the coaxially open grooves 92. The core 90 having a spiral coiled core 4 means therein which substantially reinforces the cores 90 in a diametrical direction as well as fingers 91, shown in FIG. 9, whereby a substantially round hair 5 curl is obtained, even when one is sleeping, and is resting her head indirectly thereon, through cushioning pad 2 or 28. Opening 69 is also shown, whereby bobby pins or hair clips 26 (not shown) may also be used, if desired.

FIG. 11 shows the last substantially dfferent embodiment of a hair roller 99 having pad 2 or 28 over an air-permeable or perforated core 100. The core 100 having diametrically and axially rounding bellow-like corrugations 98 which have substantially diametrically opposed walls 101 which have openings 41 therethrough, if desired. The snake-like cross-section portion of the diametrically corrugated core 100 (as shown) may also have air passage 29 openings 41 as desired or deemed necessary for enhancing the drying of one's hair 5 which is rolled around (not shown) pad 2 or 28, for example, see FIG'S. 13 and 18 having hair 5 rolled around. The core 100 is universally flexible axially but yet is substantially rigid diametrically, which is in keeping with the main objects and reasons for having this improved hair roller. Spiral coiled-like corrugations 100 may also be used, if desired, having walls 101 which are also substantially spirally diametrically opposed and integrally joined to the spirally coiled-like roundings 93 and 102. Reinforcing mesh 20, 23, 30, 42 and the like may also be used, as desired, and as was substantially disclosed in this specification and in other disclosed rollers herein. Axially center air passage 29 opening 69 is also shown in part only, because it is deemed unnecessary to be again disclosed herein. Mesh 20 is also shown, in part, being formed, for example, over one of two open ends of core 100 and the tubular-like mesh 20 ends being tucked into the center axial opening of core 100, as is in FIG'S. 2, 6, 10 and the like, if desired, shown in parent application Ser. No. 432,576.

The shoulder 104 part on the finger-like member 93, is shown, in FIG. 9, on only one finger-like member 93 for illustrative simplicity only, and which shoulder 104 is preferrably to be on all the finger-like members 93, if desired. The integral end 107 of the shouldered 104 finger 93 is smaller in coaxially opposed cross section than is the corepart of finger 93. The 107 ends are generally coaxially inserted into matching opposed openings 105, which are diametrically opposed in the ring-like members 92 and are straight or generally tapered for receiving finger end 107 therein up to the shoulder 104, if so desired. The 107 finger end may also have an integral substantially larger nub-like extreme end 106 thereon so that the shouldered finger 107 will have an interference fit thereby into opening 105 and thereby create a substantially captive engagement of the cage-like, wheel-like members 90 to each other if desired or deemed necessary. The generally diametrically opposed shoulder 104 on the substantially step-finger 93 allows the two said cage-like members 90 to be thereby held in coaxially spaced relation to each other, especially the ring-like diametrically opposed portions of ring-like members 92. Thereby the passage of air 29 and hair pins or picks portion 24 thereof is readily inserted therethrough even if a coiled member 4 resiliently forces the two cage-like members 90 generally coaxially together. Also a substantially positive reinforcing means is thereby provided for pad 2 or 28 even if the two cage-like members are generally coaxially bent on one's head as is, for example, shown in FIG. 7. The tapered hole 105 also allows the cage-like members 90 to be easily generally coaxially bend, whereby the finger ends 107 will be easily withdrawn therefrom, generally without pin-like cocking stickling therein, which generally occurs when pins are withdrawn at an angle from an opening, as is for example a nail from a board and the like.

Balding condition of one's scalp is said to be nothing more absured or even humorous about women becoming bald and for a woman it is a terrible affliction, akin in mind to losing her feminity.

For women, however, their hair is, traditionally a thing of pride and beauty. The ironic result of some of the endeavors has been the loss of the very feature they are trying to glamorize, their hair.

It is traction baldness, a condition which is unique to the female sex. It generally comes from constant pressure on the hair by at least sleeping in tight hair rollers, the pull on the scalp that generally tear or pull the hair out by the roots.

If the hair is subjected to strain over a long period of time, using tight hair rollers, for example, say two to four years, the hair follicle may shrink and dry up, discouraged by the unequal struggle, and baldness may then become substantially permanent. If the damage is of short duration, the hair should ordinarily grow back.

The core member body 100, of FIG. 11, having the bellows-like corrugations 98 which are generally a resilient substantially flexurous coaxially elongated and substantially diametrically round circumferential outer wall. The disclosed wall having diametrically opposed integral groove-like 103 portion and raised rib-like 98 configurations which are shown in part as being generally wavy in coaxial cross section. The core member body 100 may also have its bellows-like wall generally solid, if desired, that is not being air permeable. The integral raised rib-like 98 and the lower portion 102 which substantially create a spiral or diametrically opposed groove-like 103 opening, which will generally reinforce a portion of pad 2 or 28 onto the outer 102 rounding portion whenever the disclosed reinforcing means 20 and the like are eliminated, if so desired. The cross section 24 (of a pin or pick 25 not shown in this figure) is shown in the groove-like opening 103 but the pin or pick may also be inserted through (not shown) the perforated openings 41, if desired, and whenever they are in the disclosed circumferential wall of the core 100. The groove-like 103 openings also allow passage of air therethrough for enhancing the drying of a tress of rolled hair (not shown) especially if the disclosed wall of core 100 is not perforated. A substantially diametrically round open-coiled wire-like body member 4 may also be spirally threaded or inserted in the inside of the substantially spirally coiled raised coil-like rounding 98 portion of core 100, if desired. The coiled core wire-like member 4 will thereby substantially diametrically reinforce the bellows-like core 100 member and would be a generally necessary construction and arrangement if the core 100 is generally greatly perforated or is made of a very thin in thickness resilient material and the like.

Since certain changes may be made in the above cushion padded hair roller means which is substantially diametrically rigid and yet substantially coaxially and/or axially bendable without departing from the scope of the invention herein involved, it is intended that all matter contained in the above description and in the paragraph herebelow or shown in the accompanying drawings shall be interpreted as illustrative and not in the limiting sense.

The coiled first body member 4 shown in FIG. 5, for example, may be eliminated if the cage-like member 75 is substantially rigid diametrically and yet flexuous coaxially through the center diagonal members 69, whereby cushioning pad material means 2 and/or 28 does not require reinforcing means 20 or pins coaxially along the now first body member means 75 or perforated core member 75, if so desired. It also may be desired to use core member 75 alone, without pad material means 2 and/or 28 accordingly for rolling a person's or one's hair 5. Two left and right cores 75 are also to be used, one inside of the other, for creating a crossed and overlapping flexuous effect to the center members diagonally 69 shown, when desired.

The zigsag pattern of FIG. 9 center flexuous portion may accordingly also be integrally constructed with the two end perforated cores 90.

What we claim is:

1. A hair roller having an elongated generally tubular-like configuration and comprising in combination: a first body member which is coaxially universally resilient and flexible in at least one portion of its generally elongated tubular-like longitudinal length and being substantially rigid diametrically and round in at least one portion of its said length, said member having a soft, resilient, flexible and air permeable tubular-like cushioning pad member means substantially embraced around at least one outer diametrical portion of said member for substantially protective cushioning of at least one outer diametrical portion of said length of said member from a person's scalp and for substantially protecting at least one portion of a person's strand of hair which is substantially rolled around at least one portion of said pad member means, said roller is so constructed and arranged that at least one portion of a person's scalp is substantially prevented from becoming numb; balding of a person's scalp is substantially reduced; sleep is enhanced; at least one strand of hair is substantially protected; stiff necks are substantially reduced; especially when a person is sleeping on at least one portion of said roller dressed in their hair.

2. The combination according to claim 1 in which said pad member means is air permeable in that a substantially free passage of air may flow through at least one portion of said pad member means.

3. The combination according to claim 2 in which said member is substantially spirally coiled in at least one portion of its said length.

4. The combination to claim 3 in which said member is spirally open-coiled in at least one portion of its said length.

5. The combination according to claim 3 wherein a reinforcing means having at least one portion thereof substantially coaxially spanning across at least one outer diametrical portion of the substantially spirally coiled portion of said member for substantially reinforcing and preventing at least one inside coaxial wall portion of said pad member means from being forced substantially inbetween at least one said coiled portion of said member by at least one strand of hair when said hair is substantially rolled around said portion of said pad member means.

6. The combination according to claim 4 wherein a reinforcing means having at least one portion thereof substantially coaxially spanning across at least one outer diametrical portion of said open-coiled and said portion of said member for substantially reinforcing and preventing at least one inside coaxial wall portion of said pad member means from being forced substantially inbetween at least one said open-coiled and said portion of said member by at least one strand of hair which is substantially rolled around said portion of said pad member means.

7. The combination according to claim 6 wherein said reinforcing means being a coaxially elongated and universally flexuous mesh-like means which is substantially embraced around the entire outer said length of said member and said mesh-like means having at least one end portion thereof substantially tucked into at least one coaxial hollow end portion of said member for substantially captively confining said mesh-like means to said member.

8. The combination according to claim 7 wherein said mesh-like means is additionally tucked into said end portion of said member for substantially controlling the coaxial limpness of said member in at least one open-coiled portion of said length of said member, whereby less straining of at least one shrinking strand of hair is required to coaxially bend said length of said member towards a person's scalp which is also numbed less especially when a bending force is applied to one end of said member towards a person's scalp and especially when sleeping.

9. The combination according to claim 8 wherein said pad member means having a coaxially bendable reinforcing means substantially therein for additionally reinforcing said pad member from being substantially forced inbetween said open-coiled portion of said member.

10. The combination according to claim 9 wherein said reinforcing means is a coaxially universally flexuous mesh-like reinforcing means.

11. The combination according to claim 9 wherein said reinforcing means being at least 3 pin-like longitudinally extending resilient and flexible reinforcing means having its length extending substantially parallel to the coaxial longitudinal length of said member.

12. The combination according to claim 9 wherein said reinforcing means is secured by a securing means substantially to at least one inside coaxial wall portion of said pad member for preventing at least one portion of the inside coaxial wall portion of said pad member means from being substantially forced inbetween at least one portion of said open-coiled portion of said member.

13. The combination according to claim 12 wherein a hair roller securing means is used for substantially removably securing said roller substantially to a person's hair.

14. The combination according to claim 1 wherein a hair roller securing means is used for removably securing said roller substantially to a person's hair.

* * * * *

UNITED STATES PATENT OFFICE

CERTIFICATE OF CORRECTION

Patent No. 3,960,157 Dated June 1, 1976

Inventor(s) Ann Andrews, et al

It is certified that error appears in the above-identified patent and that said Letters Patent are hereby corrected as shown below:

The term of this patent subsequent to April 4, 1989, has been disclaimed.

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*